US009437931B2

(12) United States Patent
Chen et al.

(10) Patent No.: US 9,437,931 B2
(45) Date of Patent: Sep. 6, 2016

(54) MOBILE DEVICE AND ANTENNA STRUCTURE USING IONIC POLYMER METAL COMPOSITE THEREIN

(71) Applicant: HTC Corporation, Taoyuan, Taoyuan County (TW)

(72) Inventors: Chien-Chih Chen, Taoyuan (TW); Guo-Dung Su, Taipei (TW); Yen-Liang Kuo, Taoyuan (TW); Wan-Ming Chen, Taoyuan (TW); Chun-Wei Tseng, Taoyuan (TW)

(73) Assignee: HTC Corporation, Taoyuan (TW)

( * ) Notice: Subject to any disclaimer, the term of this patent is extended or adjusted under 35 U.S.C. 154(b) by 394 days.

(21) Appl. No.: 14/030,538

(22) Filed: Sep. 18, 2013

(65) Prior Publication Data

US 2015/0077298 A1 Mar. 19, 2015

(51) Int. Cl.
*H01Q 9/00* (2006.01)
*H01Q 9/14* (2006.01)

(52) U.S. Cl.
CPC ..... *H01Q 9/14* (2013.01)

(58) Field of Classification Search
CPC ..... H01Q 3/00; H01Q 9/14; H01Q 5/00
USPC ..... 343/745, 749, 751
See application file for complete search history.

(56) References Cited

U.S. PATENT DOCUMENTS 6,204,819 B1 3/2001 Hayes et al.
7,714,514 B1 5/2010 Rutherford
7,764,236 B2 * 7/2010 Hill ..... H01Q 1/243 343/702
8,055,219 B2 * 11/2011 Jenkins ..... H04B 1/0458 343/700 MS
8,941,546 B2 * 1/2015 King ..... H01Q 1/1257 343/714
2006/0289657 A1 12/2006 Rosenberg
2007/0146222 A1 * 6/2007 Mansour ..... H01Q 1/3283 343/757
2009/0015498 A1 * 1/2009 Deng ..... H01Q 1/246 343/757
2011/0298688 A1 12/2011 Jalali Mazlouman et al.

FOREIGN PATENT DOCUMENTS

TW M460421 U1 8/2013

OTHER PUBLICATIONS

Taiwanese Office Action and Search Report, dated Sep. 30, 2015, for Taiwanese Application No. 102140040.

* cited by examiner

*Primary Examiner* — Dameon E Levi
*Assistant Examiner* — Hasan Islam
(74) *Attorney, Agent, or Firm* — Birch, Stewart, Kolasch & Birch, LLP

(57) ABSTRACT

A mobile device includes an antenna structure, a signal source, and an IPMC (Ionic Polymer Metal Composite). The signal source is configured to excite the antenna structure. The IPMC is configured as a flexible actuator to adjust a resonant length of the antenna structure in such a manner that the antenna structure is capable of operating in multiple bands.

19 Claims, 8 Drawing Sheets

MOBILE DEVICE AND ANTENNA STRUCTURE USING IONIC POLYMER METAL COMPOSITE THEREIN

BACKGROUND OF THE INVENTION

1. Field of the Invention

The subject application generally relates to a mobile device, and more specifically, relates to a mobile device including an IPMC (Ionic Polymer Metal Composite) for adjusting an effective resonant length of an antenna element.

2. Description of the Related Art

With the progress of mobile communication technology, mobile devices, for example, portable computers, mobile phones, multimedia players, and other hybrid functional portable electronic devices, have become more common. To satisfy the demand of users, mobile devices usually can perform wireless communication functions. Some devices cover a large wireless communication area, for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

In a mobile device, an antenna element is an essential component for wireless communication. To cover multiple bands, in the conventional design, some electronic components (e.g., diodes) are often incorporated into the antenna element and used as switches. These switches are configured to adjust the resonant length of the antenna element. However, these electronic components generally cannot form perfect shorted-circuits or perfect open-circuits while they are switching, and therefore they may increase power consumption and degrade the radiation performance of the antenna element.

BRIEF SUMMARY OF THE INVENTION

In one exemplary embodiment, the subject application is directed to a mobile device, including: an antenna structure; a signal source, configured to excite the antenna structure; and an IPMC (Ionic Polymer Metal Composite); the IPMC is configured as a flexible actuator to adjust a resonant length of the antenna structure in such a manner that the antenna structure is capable of operating in multiple bands.

In another exemplary embodiment, the subject application is directed to a method for controlling antenna bands for use in a mobile device, including the steps of: providing an antenna structure and an IPMC (Ionic Polymer Metal Composite); configuring the IPMC as a flexible actuator; and adjusting a resonant length of the antenna structure by the IPMC in such a manner that the antenna structure is capable of operating in multiple bands.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
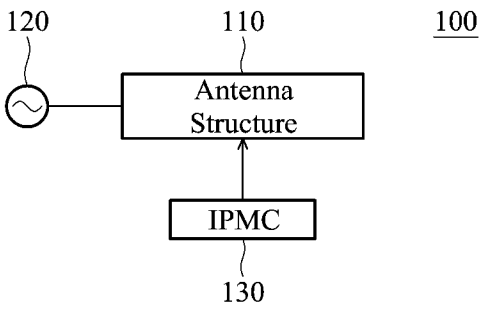
FIG. 1 is a diagram for illustrating a mobile device according to an embodiment of the invention.

FIG. 1 is a diagram for illustrating a mobile device 100 according to an embodiment of the invention. The mobile device 100 may be a smart phone, a tablet computer, or a notebook computer. As shown in FIG. 1, the mobile device 100 at least includes an antenna structure 110, a signal source 120, and IPMC (Ionic Polymer Metal Composite) 130. The type of antenna structure 110 is not limited in the invention. For example, the antenna structure 110 may include a monopole antenna, a dipole antenna, a loop antenna, a patch antenna, a slot antenna, and/or a PIFA (Planar Inverted F Antenna). The signal source 120 may be an RF (Radio Frequency) module. In some embodiments, the signal source 120 is coupled through a coaxial cable (not shown) to the antenna structure 110 and is configured to excite the antenna structure 110. The IPMC 130 is configured as a flexible and deformable actuator to adjust the effective resonant length of the antenna structure 110 in such a manner that the antenna structure 110 is capable of operating in multiple bands. The detailed operations of the IPMC 130 will be described in the following embodiments. Note that the mobile device 100 may at least further include other components, such as a touch panel, a touch control module, a processor, a sensor, a micro control unit, a power supply module, a speaker, and a housing (not shown).

Figure 2B:
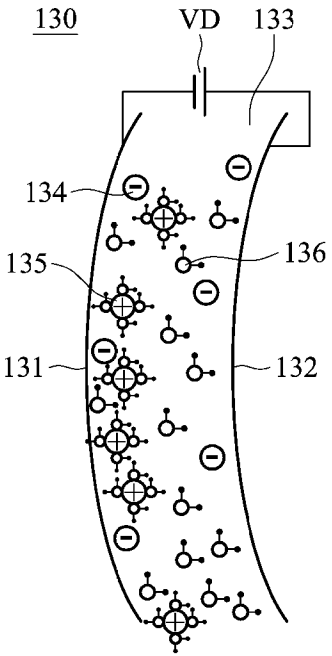
FIG. 2B is a diagram for illustrating an deformed IPMC according to an embodiment of the invention.
Figure 2A:
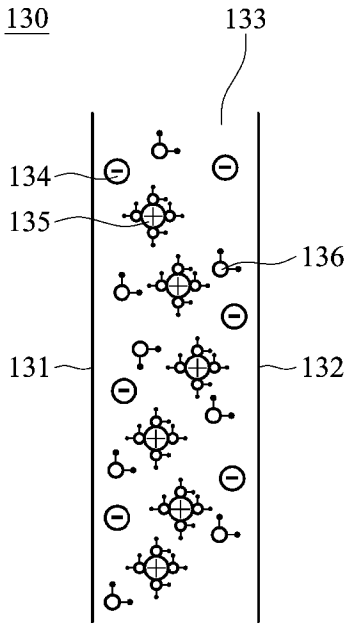
FIG. 2A is a diagram for illustrating an IPMC (Ionic Polymer Metal Composite) according to an embodiment of the invention.

FIG. 2A is a diagram for illustrating the IPMC 130 according to an embodiment of the invention. As shown in FIG. 2A, the IPMC 130 includes two metal layers 131 and 132 and an ion-exchange membrane 133. The ion-exchange membrane 133 is positioned between the metal layers 131 and 132. In some embodiments, the metal layers 131 and 132 are made of platinum (Pt), gold (Au), silver (Ag), or an alloy thereof. In some embodiments, the metal layers 131 and 132 are fixed onto the ion-exchange membrane 133 through an electroless plating process. The ion-exchange membrane 133 includes water molecules ($H_2O$) 136, anions 134, and cations 135. In some embodiments, the anions 134 are hydroxide ions ($OH^-$). In some embodiments, the cations 135 are lithium ions ($Li^+$) or sodium ions ($Na^+$).

FIG. 2B is a diagram for illustrating the deformed IPMC 130 according to an embodiment of the invention. As shown in FIG. 2B, when a voltage difference VD is applied to the IPMC 130, the metal layer 131 has a low voltage and the metal layer 132 has a high voltage. In this case, the hydrophilic cations 135 and the water molecules 136 move toward the low voltage, and therefore the IPMC 130 is deformed and bent. More specifically, the low voltage side of the IPMC 130 is bent and becomes convex, and the other high voltage side of the IPMC 130 is bent and becomes concave. The bending state of the IPMC 130 is changed according to the voltage difference VD. For example, when the voltage difference VD is increased, the upper and lower ends of the IPMC 130 move more toward the high voltage (i.e., the bending state becomes more pronounced). Conversely, when the voltage difference VD is decreased, omitted, or even reversed, the upper and lower ends of the IPMC 130 move back toward the low voltage (i.e., the bending state becomes relatively slight). In a preferred embodiment, the applied voltage difference VD is from about 0V to 3V, or from about −3V to 3V. By adjusting the voltage difference VD, the bending state of the IPMC 130 is easily controlled, and therefore the IPMC 130 is configured as a good actuator. Note that the invented IPMC 130 merely requires 3V or less voltage difference to be driven, and it saves more power in comparison to a conventional actuator.

Figure 3A:
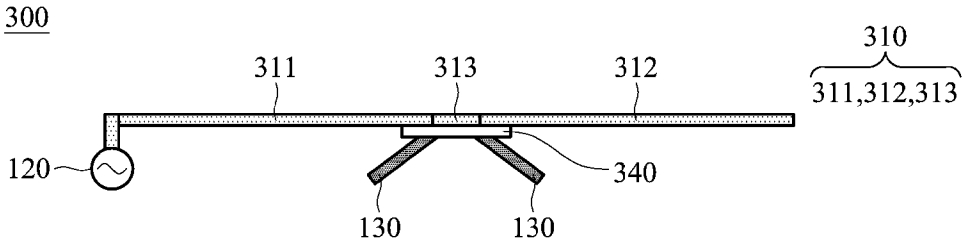
FIG. 3A is a diagram for illustrating an antenna structure of a mobile device when the antenna structure operates in a low frequency band according to an embodiment of the invention.

FIG. 3A is a diagram for illustrating an antenna structure 310 of a mobile device 300 when the antenna structure 310 operates in a low frequency band according to an embodiment of the invention. As shown in FIG. 3A, the antenna structure 310 of the mobile device 300 includes a first metal element 311, a second metal element 312, and a connection metal element 313. The first metal element 311 is coupled to a signal source 120. In some embodiments, each of the first metal element 311 and the second metal element 312 substantially has a straight-line shape, and the size of the connection metal element 313 is much smaller than those of the first metal element 311 and the second metal element 312. In other embodiments, any of the first metal element 311 and the second metal element 312 may substantially have a different shape, such as a U-shape, an L-shape, or an S-shape. The mobile device 300 may further include one or more IPMCs 130 for controlling the connection state of the connection metal element 313 of the antenna structure 310. It should be understood that although two IPMCs 130 are shown in FIG. 3A, the connection metal element 313 may be controlled by a single IPMC 130 in other embodiments (i.e., another IPMC 130 in FIG. 3A may be omitted). The bending state of the IPMC 130 may be changed according to a voltage difference such that the IPMC 130 may cause the connection metal element 313 to selectively couple or uncouple the first metal element 311 to the second metal element 312. More specifically, the IPMC 130 may adjust the position of the connection metal element 313 by changing its bending state, and therefore the connection metal element 313 may be connected or not connected to the first metal element 311 and the second metal element 312. In some embodiments, the mobile device 300 further includes an isolation layer 340, which is disposed between the IPMC 130 and the connection metal element 313 to prevent the IPMC 130 from being directly exposed to the antenna structure 310. The isolation layer 340 may be a rigid plastic plate or a glass plate, which is attached to a surface of the IPMC 130 and a surface of the connection metal element 313. The isolation layer 340 is configured to prevent a metal portion of the IPMC 130 from interfering with the radiation pattern of the antenna structure 310. In the embodiment of FIG. 3A, the connection metal element 313 couples the first metal element 311 to the second metal element 312, and the antenna structure 310 has a relatively long effective resonant path and operates in a low frequency band.

Figure 3B:
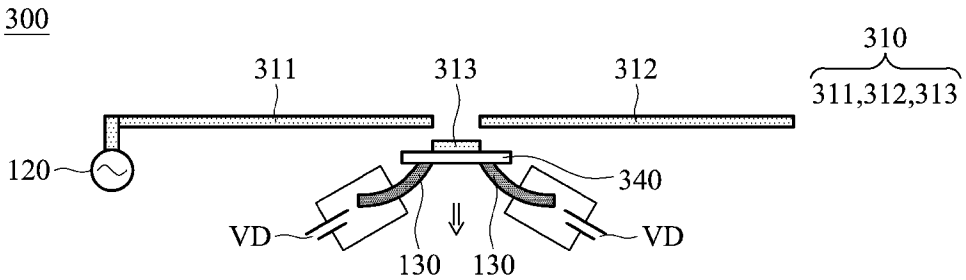
FIG. 3B is a diagram for illustrating an antenna structure of a mobile device when the antenna structure operates in a high frequency band according to an embodiment of the invention.

FIG. 3B is a diagram for illustrating the antenna structure 310 of the mobile device 300 when the antenna structure 310 operates in a high frequency band according to an embodiment of the invention. In the embodiment of FIG. 3B, a voltage difference VD is applied to the IPMC 130. The voltage difference VD may be generated by a processor (not shown) according to a user input signal or according to a control signal from other components. When the IPMC 130 receives the voltage difference VD, the bending state of the IPMC 130 becomes more pronounced due to its deformation, and therefore the connection metal element 313 moves away from the first metal element 311 and the second metal element 312. Since the connection metal element 313 does not couple the first metal element 311 to the second metal element 312, the antenna structure 310 has a relatively short effective resonant path and operates in a high frequency band. Note that when the voltage difference VD is decreased, omitted, or even reversed, the antenna structure 310 is changed back to the connection state as shown in FIG. 3A, and operates in a low frequency band.

Figure 3C:
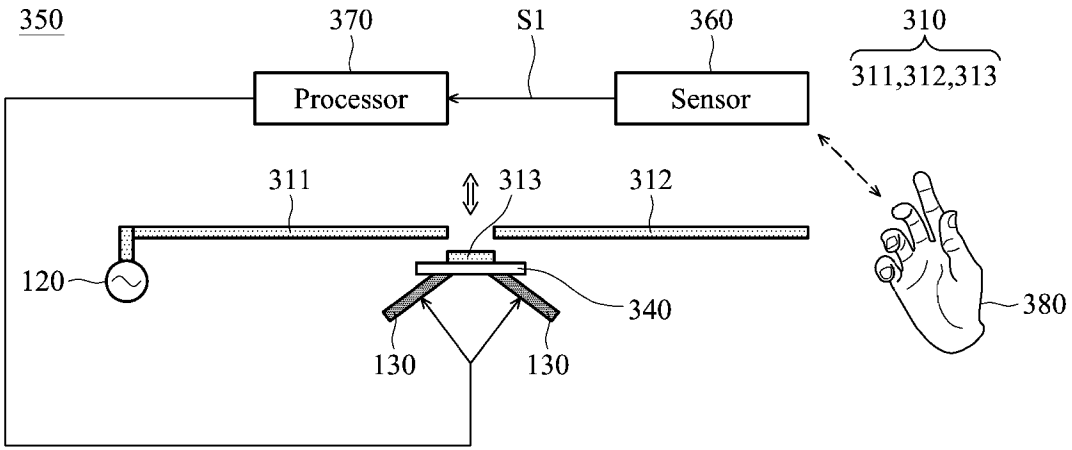
FIG. 3C is a diagram for illustrating a mobile device according to an embodiment of the invention.

FIG. 3C is a diagram for illustrating a mobile device 350 according to an embodiment of the invention. When a human body (e.g., a head or a palm) 380 is near the antenna structure 310 of the mobile device 350, it changes the resonant length and the radiation pattern of the antenna structure 310, and further degrades the radiation performance of the antenna structure 310. To solve the aforementioned problem, in the embodiment of FIG. 3C, the mobile device 350 further includes a sensor 360 and a processor 370. For example, the sensor 360 may be a proximity sensor (P-sensor), a light sensor, a heat sensor, a biosensor, etc. The proximity sensor 360, for example, is configured to detect whether a human body 380 (or a conductor) is near the antenna structure 310. More specifically, the proximity sensor 360 is disposed adjacent to the antenna structure 310, and is configured to detect an equivalent capacitance between the human body 380 and the proximity sensor 360. The proximity sensor 360 further generates a detection signal S1 according to the equivalent capacitance. Then, the processor 370 generates and controls a voltage difference VD applied to one or more IPMCs 130 according to the detection signal S1 so as to adjust the deformation of the IPMC 130. In some embodiments, when a human body 380 is near the antenna structure 310, the IPMC 130 causes the connection metal element 313 to not couple the first metal element 311 to the second metal element 312. In this case, the operation band of the antenna structure 310 shifts toward a high frequency band to cancel the interference from the nearby human body 380. Conversely, when the human body 380 is away from the antenna structure 310, the IPMC 130 causes the connection metal element 313 to couple the first metal element 311 to the second metal element 312. In this case, the operation band of the antenna structure 310 shifts toward a low frequency band to cancel the interference from the distant human body 380. By adjusting the effective resonant length of the antenna structure 310 with the IPMC 130, the phantom effect of the antenna structure 310 (the phantom effect represents the antenna efficiency is becoming lower when the human body is near the antenna structure) is effectively eliminated, thereby improving the communication quality of the mobile device 350. Other features of the mobile device 350 of FIG. 3C are similar to those of the mobile device 300 of FIG. 3A and FIG. 3B. Accordingly, these embodiments can achieve similar performances.

Figure 4:
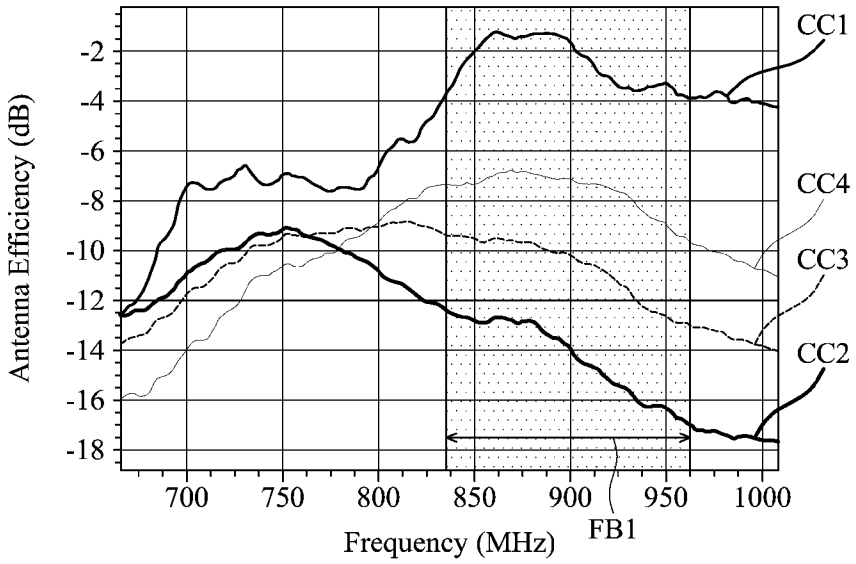
FIG. 4 is a diagram for illustrating a comparison of antenna efficiency levels according to an embodiment of the invention.

FIG. 4 is a diagram for illustrating a comparison of antenna efficiency levels according to an embodiment of the invention. The horizontal axis represents operation frequency (MHz), and the vertical axis represents antenna efficiency (dB). To illustrate the effect of the invention, there are four examples as follows. In the first example, an antenna structure of a mobile device originally operates in a predetermined frequency band FB1. When no human body or conductor is near the antenna structure, the antenna efficiency of the antenna structure is shown as a curve CC1. In the second example, when a human body or a conductor is near the antenna structure, the antenna efficiency of the antenna structure falls down fast in the predetermined frequency band FB1. The antenna efficiency of the second example is shown as another curve CC2. In the third example, a diode is incorporated into the antenna structure to adjust the effective resonant length of the antenna structure, thereby cancelling the phantom effect due to the nearby human body or the nearby conductor. The antenna efficiency of the third example is shown as a curve CC3. In the fourth example, an IPMC is incorporated into the antenna structure to adjust the effective resonant length of the antenna structure, thereby cancelling the phantom effect due to the nearby human body or the nearby conductor. The antenna efficiency of the fourth example is shown as another curve CC4. According to experimental results illustrated in FIG. 4, the phantom effect is slightly improved by adding an electronic component (e.g., a diode) into the antenna structure. However, the IPMC solves the problem of the phantom effect and enhances the antenna efficiency of the antenna structure more effectively than the electronic component does. As shown in FIG. 4, the antenna efficiency of the antenna structure including the IPMC is increased by at least 3 dB in the predetermined frequency band FB1 in comparison to the antenna structure including the diode. The main reason is that the loss of the IPMC actuator should be smaller than the loss of the electronic component coupled to the antenna structure. Therefore, the invented antenna structure including the IPMC may be applied to a variety of mobile devices in which good communication quality is emphasized.

Figure 5A:
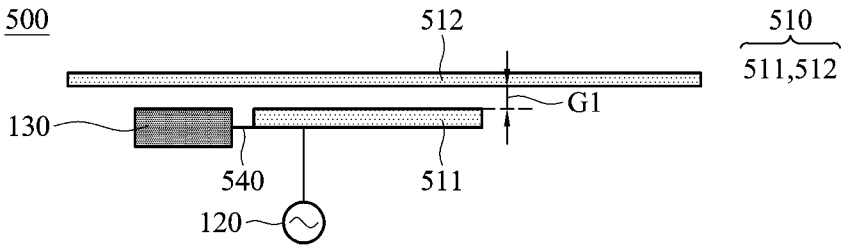
FIG. 5A is a diagram for illustrating an antenna structure of a mobile device when the antenna structure operates in a low frequency band according to an embodiment of the invention.

FIG. 5A is a diagram for illustrating an antenna structure 510 of a mobile device 500 when the antenna structure 510 operates in a low frequency band according to an embodiment of the invention. As shown in FIG. 5A, the antenna structure 510 includes a first metal element 511 and a second metal element 512. The first metal element 511 is coupled to a signal source 120. The first metal element 511 is separated from the second metal element 512, and is adjacent to the second metal element 512. In some embodiments, each of the first metal element 511 and the second metal element 512 substantially has a straight-line shape, and the size of the first metal element 511 is smaller than that of the second metal element 512. In other embodiments, any of the first metal element 511 and the second metal element 512 may substantially have a different shape, such as a U-shape, an L-shape, or an S-shape. The antenna structure 510 may be considered as a coupled-fed antenna structure, and a coupling gap may be formed between the first metal element 511 and the second metal element 512. The mobile device 500 may include one or more IPMCs 130. The bending state of the IPMC 130 may be changed according to a voltage difference such that the IPMC 130 may adjust the coupling gap between the first metal element 511 and the second metal element 512. More specifically, the IPMC 130 may move the first metal element 511 by changing its bending state to adjust the coupling gap. It should be understood that although a single IPMC 130 is shown in FIG. 5A, two or more IPMCs 130 may be configured to control the first metal element 511 in other embodiments. In some embodiments, the mobile device 500 further includes an isolation layer 540 to form a cantilever. The isolation layer 540 is disposed between the IPMC 130 and the first metal element 511 to prevent the IPMC 130 from being directly exposed to the antenna structure 510. The isolation layer 540 may be a rigid plastic plate or a glass plate, which is attached to a surface of the IPMC 130 and a surface of the first metal element 511. The isolation layer 540 is configured to prevent a metal portion of the IPMC 130 from interfering with the radiation pattern of the antenna structure 510. In the embodiment of FIG. 5A, the width of the coupling gap between the first metal element 511 and the second metal element 512 is relatively decreased (e.g., as a smaller coupling gap G1). In this case, the capacitance between the first metal element 511 and the second metal element 512 is relatively increased, and the antenna structure 510 has a relatively long effective resonant path and operates in a low frequency band. The effective resonant path includes both the first metal element 511 and the second metal element 512.

Figure 5B:
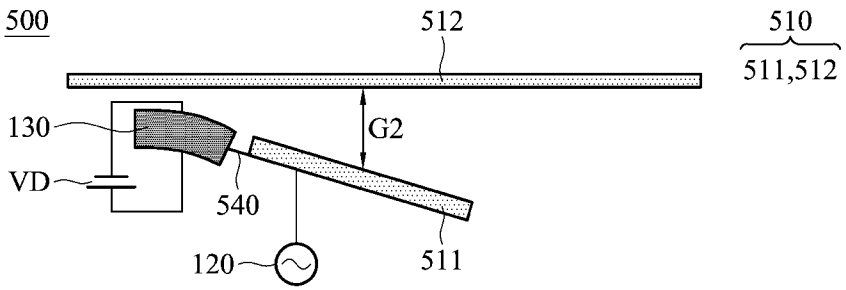
FIG. 5B is a diagram for illustrating an antenna structure of a mobile device when the antenna structure operates in a high frequency band according to an embodiment of the invention.

FIG. 5B is a diagram for illustrating the antenna structure 510 of the mobile device 500 when the antenna structure 510 operates in a high frequency band according to an embodiment of the invention. In the embodiment of FIG. 5B, a voltage difference VD is applied to the IPMC 130. The voltage difference VD may be generated by a processor (not shown) according to a user input signal or according to a control signal from other components (not shown). When the IPMC 130 receives the voltage difference VD, the bending state of the IPMC 130 becomes more pronounced due to its deformation, and therefore the first metal element 511 moves away from the second metal element 512. Since the width of the coupling gap between the first metal element 511 and the second metal element 512 is relatively increased (e.g., as a larger coupling gap G2), the capacitance between the first metal element 511 and the second metal element 512 is relatively decreased, and the antenna structure 510 has a relatively short effective resonant path and operates in a high frequency band. The effective resonant path includes just the first metal element 511. Note that when the voltage difference VD is decreased, omitted, or even reversed, the antenna structure 510 is changed back to the coupling state as shown in FIG. 5A, and operates in a low frequency band. In a preferred embodiment, the low frequency band is substantially from 704 Hz to 746 MHz, and the high frequency band is substantially from 894 MHz to 960 MHz. In some embodiments, the mobile device 500 further includes a nonconductive housing (not shown). The first metal element 511 may be disposed in the nonconductive housing. The nonconductive housing may be positioned between the first metal element 511 and the second metal element 512 to separate the first metal element 511 from the second metal element 512. In some embodiments, the second metal element 512 is patterned on the nonconductive housing through an LDS (Laser Direct Structuring) process. The nonconductive housing may be configured to limit the movement range of the first metal element 511 therein so as to effectively limit the coupling gap between the first metal element 511 and the second metal element 512. In some embodiments, the mobile device 500 further includes a sensor and a processor (not shown). For example, the sensor may be a proximity sensor, a light sensor, a heat sensor, or a biosensor, etc. The proximity sensor, for example, is configured to detect whether a human body (not shown) is near the antenna structure 510 and accordingly generate a detection signal. The processor generates and controls the voltage difference VD applied to the IPMC 130 according to the detection signal. In some embodiments, when the human body is near the antenna structure 510, the width of the coupling gap between the first metal element 511 and the second metal element 512 is increased, and when the human body is away from the antenna structure 510, the width of the coupling gap between the first metal element 511 and the second metal element 512 is decreased. By adjusting the effective resonant length of the antenna structure 510 with the IPMC 130, the phantom effect of the antenna structure 510 is effectively eliminated, thereby improving the communication quality of the mobile device 500. Other features of the mobile device 500 of FIG. 5A and FIG. 5B are similar to those of the mobile devices 300 and 350 of FIG. 3A, FIG. 3B and FIG. 3C. Accordingly, these embodiments can achieve similar performances.

Figure 6A:
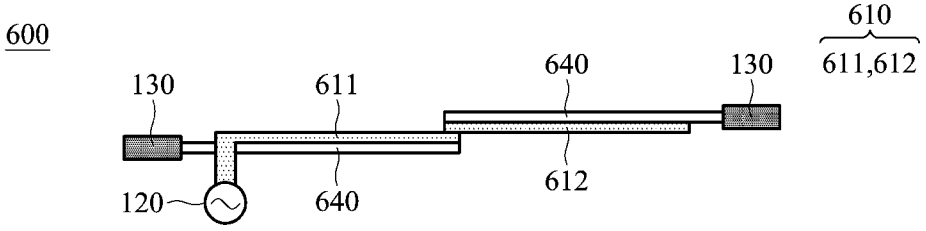
FIG. 6A is a diagram for illustrating an antenna structure of a mobile device when the antenna structure operates in a low frequency band according to an embodiment of the invention.

FIG. 6A is a diagram for illustrating an antenna structure 610 of a mobile device 600 when the antenna structure 610 operates in a low frequency band according to an embodiment of the invention. As shown in FIG. 6A, the antenna structure 610 of the mobile device 600 includes a first metal element 611 and a second metal element 612. The first metal element 611 is coupled to a signal source 120. In some embodiments, each of the first metal element 611 and the second metal element 612 substantially has a straight-line shape, and the size of the first metal element 611 is substantially equal to that of the second metal element 612. In other embodiments, any of the first metal element 611 and the second metal element 612 may substantially have a different shape, such as a U-shape, an L-shape, or an S-shape. The mobile device 600 may include one or more IPMCs 130. The bending state of the IPMC 130 may be changed according to a voltage difference such that the IPMC 130 may cause the first metal element 611 to be dynamically, selectively connected or not connected to the second metal element 612. More specifically, the IPMC 130 may move the first metal element 611 and/or the second metal element 612 by changing its bending state, and therefore the first metal element 611 and the second metal element 612 may be close to or away from each other. It should be understood that although two IPMCs 130 for respectively controlling the first metal element 611 and the second metal element 612 are shown in FIG. 6A, either the first metal element 611 or the second metal element 612 may be controlled by a single IPMC 130 in other embodiments (i.e., another IPMC 130 in FIG. 6A may be omitted). In some embodiments, the mobile device 600 further includes one or more isolation layers 640 to form a cantilever. The isolation layers 640 are disposed between the IPMC 130 and the first metal element 611, and/or are disposed between the IPMC 130 and the second metal element 612, to prevent the IPMC 130 from being directly exposed to the antenna structure 610. The isolation layer 640 may be a rigid plastic plate or a glass plate, which is attached to a surface of the IPMC 130 and a surface of the first metal element 611, and/or is attached to a surface of the IPMC 130 and a surface of the second metal element 612. The isolation layer 640 is configured to prevent the metal portion of the IPMC 130 from interfering with the radiation pattern of the antenna structure 610. In the embodiment of FIG. 6A, the first metal element 611 is connected to the second metal element 612, and the antenna structure 610 has a relatively long effective resonant path and operates in a low frequency band.

Figure 6B:
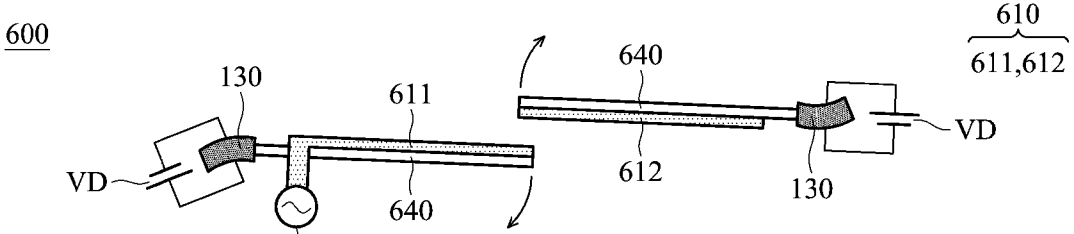
FIG. 6B is a diagram for illustrating an antenna structure of a mobile device when the antenna structure operates in a high frequency band according to an embodiment of the invention.

FIG. 6B is a diagram for illustrating the antenna structure 610 of the mobile device 600 when the antenna structure 610 operates in a high frequency band according to an embodiment of the invention. In the embodiment of FIG. 6B, a voltage difference VD is applied to the IPMC 130. The voltage difference VD may be generated by a processor (not shown) according to a user input signal or according to a control signal from other components (not shown). When the IPMC 130 receives the voltage difference VD, the bending state of the IPMC 130 becomes more pronounced due to its deformation, and therefore the first metal element 611 moves away from the second metal element 612. Since the first metal element 611 is not connected to the second metal element 612, the antenna structure 610 has a relatively short effective resonant path and operates in a high frequency band. Note that when the voltage difference VD is decreased, omitted, or even reversed, the antenna structure 610 is changed back to the connection state as shown in FIG. 6A, and operates in a low frequency band. In a preferred embodiment, the low frequency band is substantially from 704 Hz to 746 MHz, and the high frequency band is substantially from 894 MHz to 960 MHz. In some embodiments, the mobile device 600 further includes a sensor and a processor (not shown). For example, the sensor may be a proximity sensor, a light sensor, a heat sensor, or a biosensor, etc. The proximity sensor, for example, is configured to detect whether a human body (not shown) is near the antenna structure 610 and accordingly generate a detection signal. The processor generates and controls the voltage difference VD applied to the IPMC 130 according to the detection signal. In some embodiments, when a human body is near the antenna structure 610, the first metal element 611 is not connected to the second metal element 612, and when the human body is away from the antenna structure 610, the first metal element 611 is connected to the second metal element 612. By adjusting the resonant length of the antenna structure 610 with the IPMC 130, the phantom effect of the antenna structure 610 is effectively eliminated, thereby improving the communication quality of the mobile device 600. Other features of the mobile device 600 of FIG. 6A and FIG. 6B are similar to those of the mobile devices 300 and 350 of FIG. 3A, FIG. 3B and FIG. 3C. Accordingly, these embodiments can achieve similar performances.

In the embodiments of FIGS. 3A-3C, 5A-5B, and 6A-6B, the aforementioned antenna structures generate a low frequency band when no voltage difference is applied to the IPMC 130, and generate a high frequency band when a voltage difference is applied to the IPMC 130. However, the invention is not limited to the above. In some embodiments, the aforementioned antenna structures may generate a low frequency band when a voltage difference is applied to the IPMC 130, and may generate a high frequency band when the voltage difference is decreased, omitted, or even reversed. In some embodiments, the aforementioned antenna structures may generate a high frequency band when a voltage difference is applied to the IPMC 130, and may generate a low frequency band when the voltage difference is decreased, omitted, or even reversed. In other words, the aforementioned voltage difference may have different positive and negative sides according to a variety of design requirements.

Figure 7:
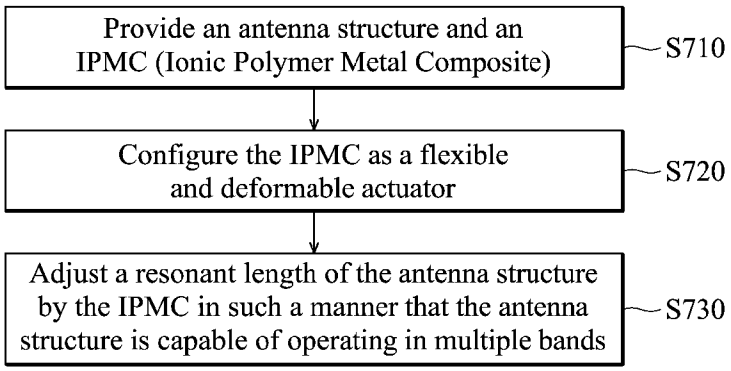
FIG. 7 is a flowchart for illustrating a method for controlling antenna bands according to an embodiment of the invention.

FIG. 7 is a flowchart for illustrating a method for controlling antenna bands according to an embodiment of the invention. The method for use in a mobile device includes at least the following steps. To begin, in step S710, an antenna structure and an IPMC (Ionic Polymer Metal Composite) are provided. Next, in step S720, the IPMC is configured as a flexible and deformable actuator. Finally, in step S730, a resonant length of the antenna structure is adjusted by the IPMC in such a manner that the antenna structure is capable of operating in multiple bands. Note that any one or more features of the embodiments of FIGS. 1-6 may be applied to the control method of FIG. 7, and they will not be described here again.

The above element sizes, element shapes, element parameters, and frequency ranges are just exemplary but not limitations of the invention. These setting values may be adjusted by a designer according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for ordinal term) to distinguish the claim elements.

The embodiments of the disclosure are considered as exemplary only, not limitations. It will be apparent to those skilled in the art that various modifications and variations can be made in the invention. The true scope of the disclosed embodiments being indicated by the following claims and their equivalents.

What is claimed is:

1. A mobile device, comprising:

an antenna structure;

a signal source, configured to excite the antenna structure; and an IPMC (Ionic Polymer Metal Composite), wherein the IPMC is configured as a flexible actuator to adjust a resonant length of the antenna structure in such a manner that the antenna structure is capable of operating in multiple bands, wherein the antenna structure comprises a first metal element, a second metal element, and a connection metal element, wherein the first metal element is coupled to the signal source, and a bending state of the IPMC is changed according to a voltage difference such that the IPMC causes the connection metal element to selectively couple or uncouple the first metal element to the second metal element.

2. The mobile device as claimed in claim 1, wherein the IPMC comprises two metal layers and an ion-exchange membrane, the ion-exchange membrane is positioned between the metal layers, the metal layers are fixed onto the ion-exchange membrane through an electroless plating process, and the ion-exchange membrane comprises a plurality of water molecules, anions, and cations.

3. The mobile device as claimed in claim 1, wherein the IPMC moves the connection metal element by changing the bending state.

4. The mobile device as claimed in claim 1, wherein when the connection metal element couples the first metal element to the second metal element, the antenna structure operates in a low frequency band, and wherein when the connection metal element does not couple the first metal element to the second metal element, the antenna structure operates in a high frequency band.

5. The mobile device as claimed in claim 1, further comprising:

an isolation layer, disposed between the IPMC and the connection metal element to prevent the IPMC from being directly exposed to the antenna structure.

6. The mobile device as claimed in claim 1, further comprising:

a sensor, detecting whether a human body is near the antenna structure, and accordingly generating a detection signal; and a processor, generating and controlling the voltage difference applied to the IPMC according to the detection signal.

7. The mobile device as claimed in claim 6, wherein when the human body is near the antenna structure, the connection metal element does not couple the first metal element to the second metal element, and when the human body is away from the antenna structure, the connection metal element couples the first metal element to the second metal element.

8. A mobile device, comprising:

an antenna structure;

a signal source, configured to excite the antenna structure; and an IPMC (Ionic Polymer Metal Composite), wherein the IPMC is configured as a flexible actuator to adjust a resonant length of the antenna structure in such a manner that the antenna structure is capable of operating in multiple bands, wherein the antenna structure comprises a first metal element and a second metal element, wherein the first metal element is coupled to the signal source, the first metal element is separated from the second metal element and adjacent to the second metal element, and a bending state of the IPMC is changed according to a voltage difference such that the IPMC adjusts a coupling gap between the first metal element and the second metal element.

9. The mobile device as claimed in claim 8, wherein the IPMC moves the first metal element by changing the bending state.

10. The mobile device as claimed in claim 8, wherein when a width of the coupling gap is decreased, the antenna structure operates in a low frequency band, and wherein when the width of the coupling gap is increased, the antenna structure operates in a high frequency band.

11. The mobile device as claimed in claim 8, further comprising:

a sensor, detecting whether a human body is near the antenna structure, and accordingly generating a detection signal; and a processor, generating and controlling the voltage difference applied to the IPMC according to the detection signal.

12. The mobile device as claimed in claim 11, wherein when the human body is near the antenna structure, the width of the coupling gap is increased, and when the human body is away from the antenna structure, the width of the coupling gap is decreased.

13. A mobile device, comprising:

an antenna structure;

a signal source, configured to excite the antenna structure; and an IPMC (Ionic Polymer Metal Composite), wherein the IPMC is configured as a flexible actuator to adjust a resonant length of the antenna structure in such a manner that the antenna structure is capable of operating in multiple bands, wherein the antenna structure comprises a first metal element and a second metal element, wherein the first metal element is coupled to the signal source, and a bending state of the IPMC is changed according to a voltage difference such that the IPMC causes the first metal element to be selectively connected or not connected to the second metal element.

14. The mobile device as claimed in claim 13, wherein the IPMC moves the first metal element or the second metal element by changing the bending state.

15. The mobile device as claimed in claim 13, wherein the IPMC moves the first metal element and the second metal element by changing the bending state.

16. The mobile device as claimed in claim 13, wherein when the first metal element is connected to the second metal element, the antenna structure operates in a low frequency band, and wherein when the first metal element is not connected to the second metal element, the antenna structure operates in a high frequency band.

17. The mobile device as claimed in claim 13, further comprising:

a sensor, detecting whether a human body is near the antenna structure, and accordingly generating a detection signal; and a processor, generating and controlling the voltage difference applied to the IPMC according to the detection signal.

18. The mobile device as claimed in claim 17, wherein when the human body is near the antenna structure, the first metal element is not connected to the second metal element, and when the human body is away from the antenna structure, the first metal element is connected to the second metal element.

19. A method for controlling antenna bands for use in a mobile device, comprising the steps of:

providing an antenna structure and an IPMC (Ionic Polymer Metal Composite);

configuring the IPMC as a flexible actuator; and adjusting a resonant length of the antenna structure by the IPMC in such a manner that the antenna structure is capable of operating in multiple bands, wherein the antenna structure comprises a first metal element, a second metal element, and a connection metal element, wherein the first metal element is coupled to the signal source, and a bending state of the IPMC is changed according to a voltage difference such that the IPMC causes the connection metal element to selectively couple or uncouple the first metal element to the second metal element.

* * * * *